US011958648B2

(12) United States Patent
Bruls et al.

(10) Patent No.: US 11,958,648 B2
(45) Date of Patent: Apr. 16, 2024

(54) DUNNAGE PRODUCT TRANSFER USING AN ALIGNMENT REFERENCE PLANE

(71) Applicant: Ranpak Corp., Concord Township, OH (US)

(72) Inventors: Ruud Bruls, Schimmert (NL); Jordy Van Der Kaap, Schimmert (NL)

(73) Assignee: Ranpak Corp., Concord Township, OH (US)

( * ) Notice: Subject to any disclaimer, the term of this patent is extended or adjusted under 35 U.S.C. 154(b) by 87 days.

(21) Appl. No.: 17/906,659

(22) PCT Filed: Mar. 17, 2021

(86) PCT No.: PCT/US2021/022772

§ 371 (c)(1),
(2) Date: Sep. 19, 2022

(87) PCT Pub. No.: WO2021/188676

PCT Pub. Date: Sep. 23, 2021

(65) Prior Publication Data

US 2023/0136380 A1 May 4, 2023

Related U.S. Application Data

(60) Provisional application No. 62/990,923, filed on Mar. 17, 2020.

(51) Int. Cl.
*B65B 61/22* (2006.01)
*B65B 57/04* (2006.01)

(52) U.S. Cl.
CPC ..... *B65B 61/22* (2013.01); *B65B 57/04* (2013.01)

(58) Field of Classification Search
CPC ..... B31D 2205/0082; B31D 2205/007; B31D 2205/0088; B65B 55/20; B65B 61/22; B65B 5/02; B65B 2210/04
(Continued)

(56) References Cited

U.S. PATENT DOCUMENTS 4,717,613 A 1/1988 Ottaviano
5,542,232 A 8/1996 Beierlorzer
(Continued)

FOREIGN PATENT DOCUMENTS

DE 1020170023251 A 9/2018
JP 2011126559 A 6/2011
(Continued)

OTHER PUBLICATIONS

International Preliminary Report on Patentability dated Sep. 20, 2022, for International Patent Application No. PCT/US2021/022772.
(Continued)

*Primary Examiner* — Jacob A Smith
(74) *Attorney, Agent, or Firm* — Renner, Otto, Boisselle & Sklar, LLP

(57) ABSTRACT

A packaging system for transferring a dunnage product to a packaging container includes a dunnage sensor configured to detect the dunnage product registered at an alignment reference plane in a staging location. The packaging system also includes a package sensor configured to detect the packaging container registered at the alignment reference plane in a loading location. A dunnage placement apparatus is configured to transfer the dunnage product from the staging location to the packaging container in the loading location after both the dunnage sensor detects the dunnage product registered at the alignment reference plane in the staging location and the package sensor detects the packaging container registered at the alignment reference plane in the loading location.

18 Claims, 8 Drawing Sheets

(58) Field of Classification Search
USPC ..... 53/505
See application file for complete search history.

(56) References Cited

U.S. PATENT DOCUMENTS

| | | | |
|---|---|---|---|
| 5,829,231 | A | 11/1998 | Harding et al. |
| 77,225,192 | | 6/2006 | Timmers et al. |

FOREIGN PATENT DOCUMENTS

| | | | | | |
|---|---|---|---|---|---|
| WO | 20060503542 | A2 | | 5/2006 | |
| WO | WO2006050354 | | * | 5/2006 | ..... B65B 55/20 |

OTHER PUBLICATIONS

International Search Report and Written Opinion dated Jun. 25, 2021, for International Patent Application No. PCT/US2021/022772.

* cited by examiner

DUNNAGE PRODUCT TRANSFER USING AN ALIGNMENT REFERENCE PLANE

This application is a national phase of International Application No. PCT/US2021/022772, filed Mar. 17, 2021, and published in the English language; which claims priority to U.S. Provisional Patent Application No. 62/990,923 filed Mar. 17, 2020; each of which is hereby incorporated herein by reference in its entirety.

FIELD OF THE INVENTION

The present invention relates generally to the field of packaging systems, and more particularly to a packaging system for transferring a dunnage product to a packaging container.

BACKGROUND

In the process of packing an article in a packaging container for shipping the article from one location to another, a protective packaging material (dunnage product) is typically placed in the packaging container with the article. The dunnage product is included to fill any voids or to cushion the article during the shipping process. While paper in sheet form could possibly be used as a protective packaging material, it may be preferable to convert the sheets of paper into a low-density dunnage product. This conversion may be accomplished by a dunnage conversion machine, such as those disclosed in commonly assigned U.S. Pat. Nos. 4,717,613; 5,829,231; and 7,722,519.

Once a dunnage product is formed by a dunnage conversion machine, it may be transferred to a transitional member or staging location, such as a table, a conveyor, a slide, a bin, etc., where the dunnage product may be stored until an operator manually transfers the dunnage product to a packaging container, as necessary. In doing so, an operator may need to manually manipulate the orientation and positioning of the dunnage product in the packaging container to ensure sufficient protective packaging of the article in the packaging container.

SUMMARY

The present disclosure describes a packaging system that consistently aligns and orients a dunnage product relative to a packaging container into which the dunnage product is to be transferred. The packaging system achieves this consistent alignment and orientation with respect to an alignment reference plane, at which both the dunnage product and the packaging container are to be registered in their respective locations prior to transferring the dunnage product into the packaging container. With both the dunnage product and the packaging container registered at the alignment reference plane, transferring the dunnage product into the packaging container with proper alignment and orientation may be accomplished without the need for further manipulation by an operator. For example, when the alignment reference plane extends vertically and the dunnage product is positioned above, in the vertical direction, the packaging container, and both the dunnage product and the packaging container are registered at the alignment reference plane, the dunnage product may be transferred into the packaging container, such as by being dropped. The dunnage product will retain its orientation relative to the alignment reference plane and the packaging container. This arrangement may be particularly useful for lining a bottom of a packaging container or for placing a dunnage product on top of the packaging container as a final step before closing the container for shipment.

An exemplary packaging system for transferring a dunnage product to a packaging container includes a dunnage sensor configured to detect the dunnage product registered at an alignment reference plane in a staging location. The packaging system also includes a package sensor configured to detect the packaging container registered at the alignment reference plane in a loading location. The packaging system further includes a dunnage placement apparatus configured to transfer the dunnage product from the staging location to the packaging container in the loading location after both the dunnage sensor detects the dunnage product registered at the alignment reference plane in the staging location and the package sensor detects the packaging container registered at the alignment reference plane in the loading location.

One or more embodiments of the packaging system may include one or more of the following features, such as a controller configured to receive a dunnage alignment signal, transmitted from the dunnage sensor, after the dunnage sensor detects the dunnage product registered at the alignment reference plane in the staging location. The controller also may be configured to receive a package alignment signal, transmitted from the package sensor, after the package sensor detects the packaging container registered at the alignment reference plane in the loading location. The controller further may be configured to transmit, upon receipt of both the dunnage alignment signal and the package alignment signal, a dunnage placement signal to the dunnage placement apparatus. Upon receipt of the dunnage placement signal, the dunnage placement apparatus may be configured to transfer the dunnage product from the staging location to the packaging container in the loading location.

The packaging system may include the dunnage sensor being configured to detect the dunnage product registered at the alignment reference plane in the staging location when at least one point, or at least one face, on a periphery of the dunnage product is aligned with the alignment reference plane.

The packaging system may include the package sensor being configured to detect the packaging container registered at the alignment reference plane in the loading location when at least one point, or at least one face, on a periphery of the packaging container is aligned with the alignment reference plane.

The staging location may be positioned above, in a vertical direction, the loading location.

The dunnage sensor may be configured to detect the dunnage product registered at the alignment reference plane in the staging location when the dunnage product has an orientation aligned with the packaging container registered at the alignment reference plane in the loading location. The package sensor may be configured to detect the packaging container registered at the alignment reference plane in the loading location when the packaging container has an orientation aligned with the dunnage product registered at the alignment reference plane in the staging location.

The packaging system may include a staging member for positioning the dunnage product in the staging location. The staging member may have a sloped bottom wall terminating at the alignment reference plane in the staging location.

The dunnage placement apparatus may include at least one gate member pivotably mounted to the staging member for pivoting between an open and closed position. In the closed position the at least one gate member may be configured to support the dunnage product in the staging location. In the open position the at least one gate member may be configured to transfer the dunnage product from the staging location to the packaging container in the loading location.

Upon receipt of the dunnage placement signal, the at least one gate member may be configured to pivot from the closed position to the open position.

The packaging system may include a supply of dunnage product.

The supply may include a dunnage conversion machine.

The supply may include a dunnage transfer assembly configured to transfer the dunnage product from the conversion machine to the staging member.

An exemplary method of transferring a dunnage product to a packaging container includes the step of detecting the dunnage product registered at an alignment reference plane in a staging location. The method also includes the step of detecting the packaging container registered at the alignment reference plane in a loading location. The method further includes the step of transporting the dunnage product from the staging location to the packaging container in the loading location after both the step of detecting the dunnage product registered at the alignment reference plane in the staging location and the step of detecting the packaging container registered at the alignment reference plane in the loading location.

One or more embodiments of the method may include one or more of the following features or steps, such as the step of detecting the dunnage product may be performed by a dunnage sensor, the step of detecting the packaging container may be performed by a package sensor, and the step of transporting may be performed by a dunnage placement apparatus.

The method may include the step of transmitting a dunnage alignment signal after the step of detecting the dunnage product registered at the alignment reference plane in the staging location. The method also may include the step of transmitting a package alignment signal after the step of detecting the packaging container registered at the alignment reference plane in the loading location. The method further may include the step of transmitting, by a controller, upon receipt of both the dunnage alignment signal and the package alignment signal, a dunnage placement signal to the dunnage placement apparatus. The step of transporting the dunnage product may occur upon receipt of the dunnage placement signal by the dunnage placement apparatus.

The step of detecting the dunnage product may occur when at least one point, or at least one face, on a periphery of the dunnage product is aligned with the alignment reference plane.

The step of detecting the packaging container may occur when at least one point, or at least one face, on a periphery of the packaging container is aligned with the alignment reference plane.

The step of detecting the dunnage product may occur when the dunnage product has an orientation aligned with the packaging container registered at the alignment reference plane in the loading location. The step of detecting the packaging container may occur when the packaging container has an orientation aligned with the dunnage product registered at the alignment reference plane in the staging location.

The dunnage placement apparatus may include at least one gate member pivotably mounted to a staging member, on which the staging location is located, for pivoting between an open and closed position. The step of transporting the dunnage product may include pivoting the at least one gate member from the closed position to the open position.

The step of transporting the dunnage product may include dropping the dunnage product from the staging location to the packaging container in the loading location.

DETAILED DESCRIPTION

Figure 1:
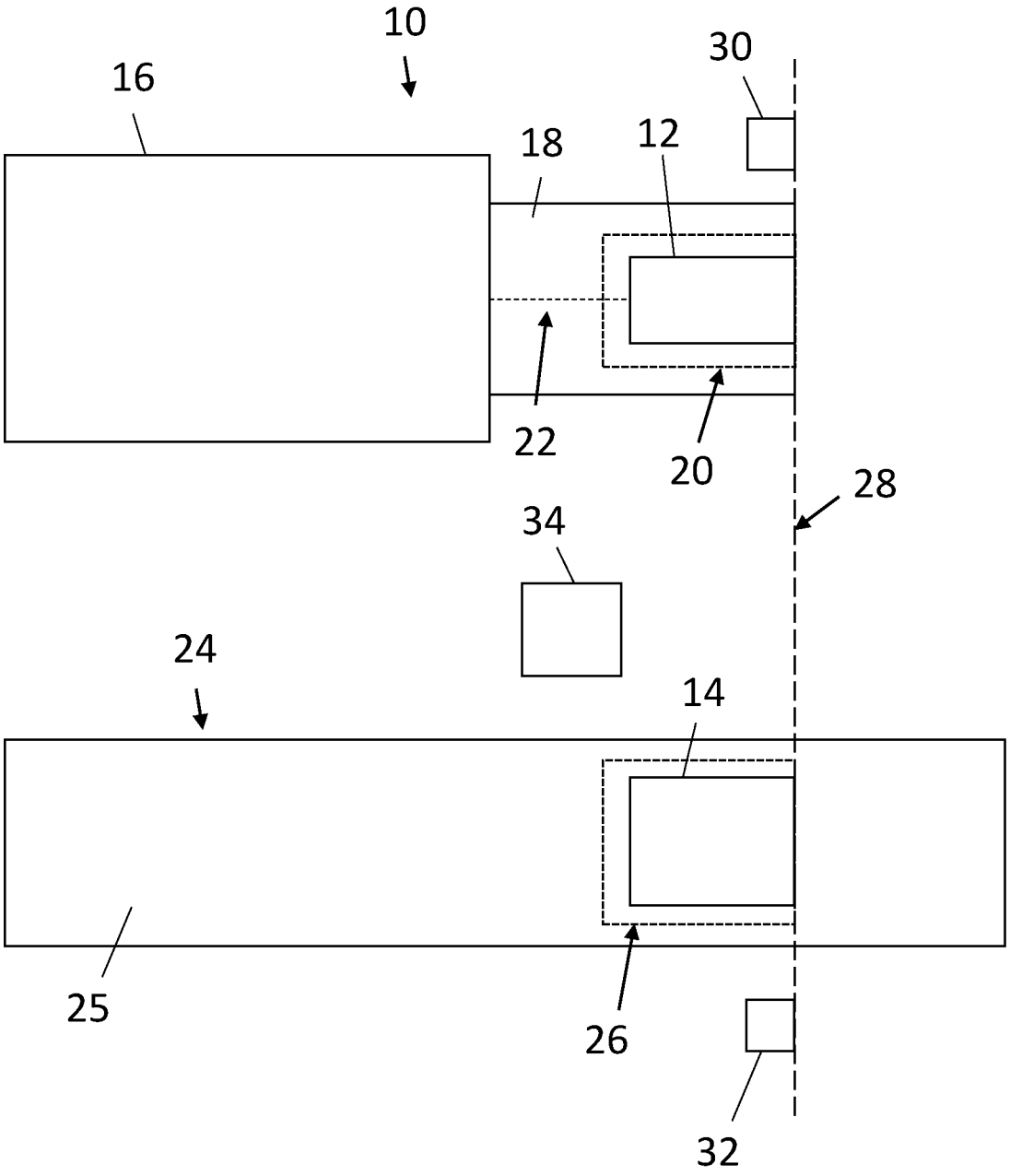
FIG. 1 is a schematic layout of an exemplary packaging system.

Turning now to the drawings, and initially to FIG. 1, FIG. 1 shows a schematic representation of an exemplary automated packaging system 10 for transferring a dunnage product 12 to (or into) a packaging container 14. The illustrated packaging system 10 includes a dunnage supply 16 for supplying the dunnage product 12, examples of which will be described in more detail below. The packaging system 10 also includes a staging member 18 for receiving the dunnage product 12 from the dunnage supply 16 and positioning, transferring, or conveying the dunnage product 12 to a staging location 20 on the staging member 18. The staging location 20 is adjacent an alignment reference plane 28. The alignment reference plane 28 forms part of a boundary of the staging location 20, such that when the dunnage product 12 is properly positioned in the staging location 20, the dunnage product 12 is registered at the alignment reference plane 28. For example, the dunnage product 12 may be registered at the alignment reference plane 28 when at least one point, or at least one face, of a periphery of the dunnage product 12 is aligned with the alignment reference plane 28. A dunnage sensor 30 is positioned adjacent the staging location 20 and the alignment reference plane 28 to detect the presence (or absence) of the dunnage product 12 registered at the alignment reference plane 28 in the staging location 20.

The packaging system 10 also includes a package conveyor assembly 24, for positioning, transferring, or conveying the packaging container 14 to a loading location 26. The loading location 26 also is adjacent the alignment reference plane 28. The alignment reference plane 28 forms part of a boundary of the loading location 26, such that when the packaging container 14 is properly positioned in the loading location 26, the packaging container 14 is registered at the alignment reference plane 28. For example, the packaging container 14 may be registered at the alignment reference plane 28 when at least one point, or at least one face, on a periphery of the packaging container 14 is aligned with the alignment reference plane 28. A package sensor 32 is positioned adjacent the loading location 26 and the alignment reference plane 28 to detect the presence (or absence) of the packaging container 14 registered at the alignment reference plane 28 in the loading location 26.

In the illustrated embodiment, the alignment reference plane 28 extends vertically, and the staging location 20 is positioned directly above the loading location 26. In this embodiment, therefore, the dunnage product 12 registered at the alignment reference plane 28 in the staging location 20 is oriented and aligned above, in the vertical direction, the packaging container 14 registered at the alignment reference plane 28 in the loading location 26. Thus, at least one point, or at least one face, on a periphery of the dunnage product 12 (i.e., an end of the dunnage product 12) is aligned with at least one point, or at least one face, on a periphery of the packaging container 14 (i.e., an end wall of the packaging container 14) since both are registered at the reference plane 28.

The packaging system 10 further includes a dunnage placement apparatus 22 for transferring the dunnage product 12 registered at the alignment reference plane 28 from the staging location 20 to a packaging container 14 registered at the alignment reference plane 28 in the loading location 26. Specifically, after detection of the dunnage product 12 registered at the alignment reference plane 28 in the staging location 20 and detection of the packaging container 14 registered at the alignment reference plane 28 in the loading location 26, the dunnage placement apparatus 22 transfers the dunnage product 12 to the packaging container 14 in such a way as to maintain the alignment and orientation of the dunnage product 12 relative to the packaging container 14.

The packaging system 10 includes a system controller 34 for controlling the coaction and interaction of the various components of the packaging system 10. The components of the packaging system 10 may, however, be controlled manually or independently of each other. The controller 34 may be a programmable controller, suitably programmed to operate the packaging system 10 in a desired manner for a given application. The functions of the controller 34 may be carried out by a single processor device or by separate devices for the various components of the packaging system 10, suitably interfaced to coordinate the operation of packaging system 10 as a whole.

Figure 2:
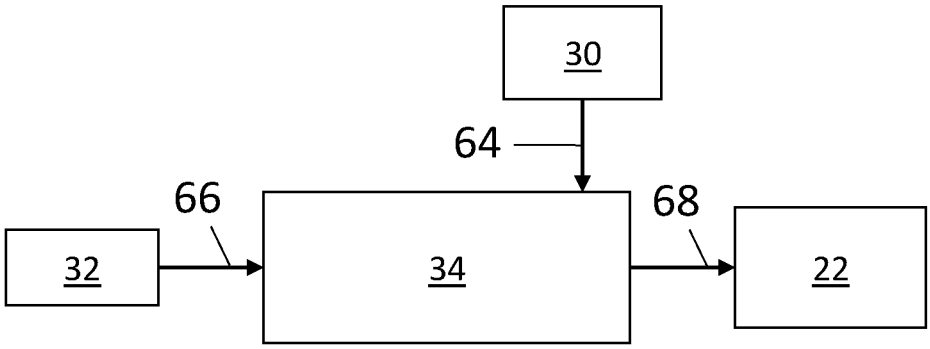
FIG. 2 is a schematic diagram of the communications and control between components of the packaging system of FIG. 1.

Turning to the schematic diagram depicted in FIG. 2, the controller 34 is configured to receive a dunnage alignment signal 64, transmitted from the dunnage sensor 30, after the dunnage sensor 30 detects the dunnage product 12 registered at the alignment reference plane 28 in the staging location 20. The controller 34 also is configured to receive a package alignment signal 66, transmitted from the package sensor 32, after the package sensor 32 detects the packaging container 14 registered at the alignment reference plane 28 in the loading location 26. After receipt of both the dunnage alignment signal 64 from the dunnage sensor 30 and the package alignment signal 66 from the package sensor 32, the controller 34 is configured to transmit a dunnage placement signal 68 to the dunnage placement apparatus 22. The controller 34 is configured to receive and send the aforementioned signals 64, 66, 68 over signal lines, depicted in FIG. 2. These signal lines may be wireless communication paths, dedicated conductors or wires, in a serial or parallel arrangement, or any other suitable means of communication as will be understood by a person of ordinary skill in the art.

Exemplary components of the packaging system 10 just described now will be described in more detail, starting with an exemplary embodiment of the dunnage supply 16 with reference to FIGS. 3 and 4. In the illustrated embodiment, the dunnage supply 16 includes a conversion machine 36 for producing the dunnage product 12 from a stock of sheet material 38. The sheet stock material 38 may be provided in the form of a roll that may be supported on an integral stock roll holder assembly 40, or the sheet stock material 38 may be provided in the form of a fan-folded stack. The sheet stock material 38 may consist of one or more, typically two or three, superimposed plies of paper, such as kraft paper. Paper is an exemplary stock material because it is biodegradable, recyclable, and composed of a renewable resource.

The sheet stock material 38 enters the conversion machine 36 at an upstream end and travels in a downstream direction through the conversion machine 36 to a downstream end. The conversion machine 36 converts the stock material 38 into a crumpled strip of dunnage that is relatively less dense than the sheet stock material 38 from which it was produced. The strip of dunnage produced by the illustrated conversion machine 36 has inwardly folded edge portions interconnected to maintain the integrity of the dunnage product 12. The conversion machine 36 also may include provision for severing, as by cutting, the strip to form a discrete dunnage product 12 of desired length. The conversion machine 36 includes an outlet opening at the downstream end through which the conversion machine 36 may discharge a fully formed dunnage product 12. The outlet opening thus may be referred to as a discharge opening and the downstream end may be referred to as the discharge end.

An exemplary dunnage product 12 produced by the illustrated conversion machine 36 includes one or more plies of sheet material that have side portions folded over center portions thereof to form laterally spaced-apart pillow portions extending along the length of the dunnage product 12. The pillow portions are separated by a central band where lateral edge portions are brought together. The lateral edge portions, which may be overlapped, interleaved, or some combination thereof, are connected together and generally also connected to underlying center portions of the plies along the central band.

The packaging system 10 is not limited to the illustrated conversion machine 36, and other types of conversion machines may be used to produce the same or other forms of dunnage products. The packaging system 10 also may operate without any conversion machine and may instead be supplied with a pre-formed dunnage product 12.

Figure 3:
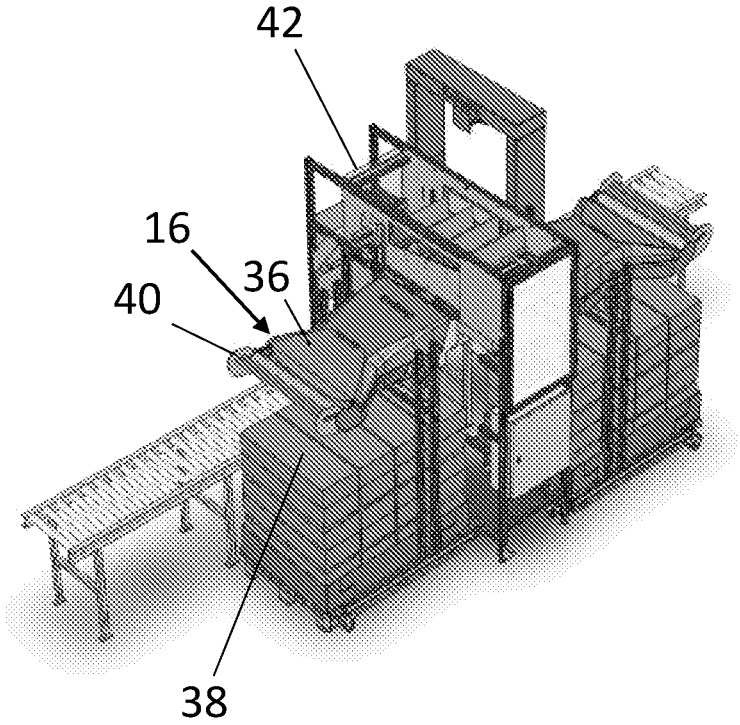
FIG. 3 is a perspective view of an exemplary embodiment of the packaging system of FIG. 1.
Figure 4:
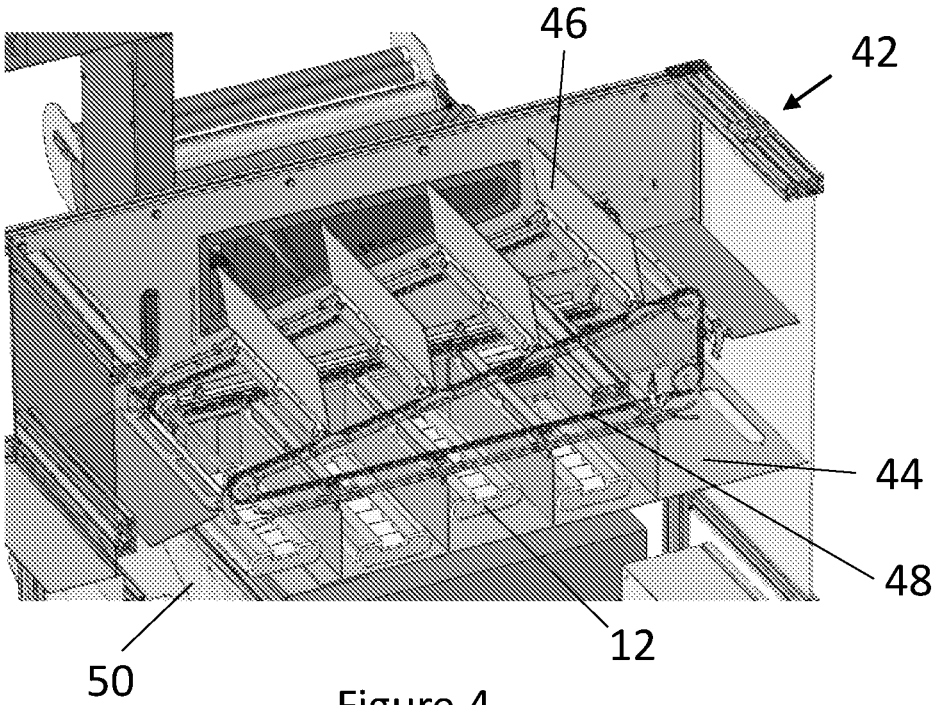
FIG. 4 is a cross-sectional perspective view of an exemplary dunnage transfer assembly of the packaging system of FIG. 3.

As illustrated in FIGS. 3 and 4, the dunnage supply 16 may additionally or alternatively include a dunnage transfer assembly 42, depicted in cross-section in FIG. 4. The dunnage transfer assembly 42 receives the dunnage product 12 and transfers the dunnage product 12 in a controlled manner to the staging member 18. This controlled movement of the dunnage product 12 avoids problems that may arise from random movement of the dunnage product 12, such as, for example, the dunnage product 12 skewing, tilting, or falling obliquely onto the staging member 18. As a consequence of such random movements, the dunnage product 12 may not be properly oriented or aligned with the alignment reference plane 28 when it arrives at the staging location 20. The dunnage transfer assembly 42 therefore is configured to avoid those problems.

In an embodiment having both the conversion machine 36 and the dunnage transfer assembly 42, the dunnage transfer assembly 42 receives the dunnage product 12 from the conversion machine 36 and transfers the dunnage product 12 onto the staging member 18. In the illustrated arrangement, the dunnage transfer assembly 42 receives the dunnage product from the opening at the discharge end of the conversion machine 36 in a first direction. The dunnage transfer assembly 42 then moves the dunnage product 12 in a second direction different from the first direction to the staging member 18. In doing so, the dunnage transfer assembly 42 separates and makes independent the movement of the dunnage product 12 in the first direction and the movement of the dunnage product 12 in the second direction.

The dunnage transfer assembly 42 may be of any suitable structure or type. The dunnage transfer assembly 42 includes a mobile or stationary transfer surface 44 that receives the dunnage product 12. The transfer surface 44 may be mounted for example between opposing side walls of the dunnage transfer assembly 42. Once received on the transfer surface 44, the dunnage transfer assembly 42 may slide the dunnage product 12 along the transfer surface 44. In the illustrated embodiment, the dunnage transfer assembly 42 includes a plurality moving paddle members 46 for this purpose. The paddle members 46 may be mounted on a moving roller assembly 48 within the dunnage transfer assembly 42, as depicted. The paddle members 46 may be uniformly spaced apart such that the space between relatively adjacent paddle members 46 is sized to accommodate a single dunnage product 12. Accordingly, in an embodiment in which multiple dunnage products 12 are being supplied to the dunnage transfer assembly 42, the dunnage transfer assembly 42 is configured to capture each dunnage product 12 separately, partitioning them one by one as they are advanced along the transfer surface 44.

In the illustrated embodiment, the dunnage supply 16 includes a pair of dunnage conversion machines 36, arranged to supply dunnage products 12 to the dunnage transfer assembly 42 from opposite sides. Thus, each dunnage conversion machine 36 fills alternate spaces between the paddle members 46.

In another embodiment, the transfer surface 44 may itself be a conveyor, such as a series of powered rollers or a belt, that urges the dunnage product 12 along the transfer surface 44 toward the staging member 18. In this embodiment, the transfer surface 44 may have at least one paddle member 46 mounted on the transfer surface 44 to partition the dunnage products 12 from each other in the same way as described in the previously described embodiment. This controlled partitioning and transferring of the dunnage products 12 also avoids problems that may arise from random or collective movement of more than one dunnage product 12 along the transfer surface 44 and onto the staging member 18. For example, random or collective movement of the dunnage products 12 may result in the dunnage products 12 skewing, tilting, falling obliquely, or piling up on the staging member 18. As a consequence of this, the dunnage products 12 may be improperly oriented or aligned with the alignment reference plane 28 when they arrive in the staging location 20. As previously described, the dunnage transfer assembly 42 is therefore configured to avoid those problems.

The dunnage product 12 may be transferred to the staging member 18 through an opening 50 of the dunnage transfer assembly 42 located at a downstream end of the transfer surface 44. The opening 50, for example, may extend transversely with respect to the longitudinal axis of the dunnage transfer assembly 42 and have dimensions slightly greater than the dimensions of the dunnage product 12. The staging member 18 may be positioned adjacent the opening 50 of the dunnage transfer assembly 42, for example underneath the opening 50. Accordingly, when the dunnage product 12 reaches the opening 50, it will pass through the opening 50 onto the staging member 18 in a controlled manner, maintaining its alignment and orientation.

Figure 5:
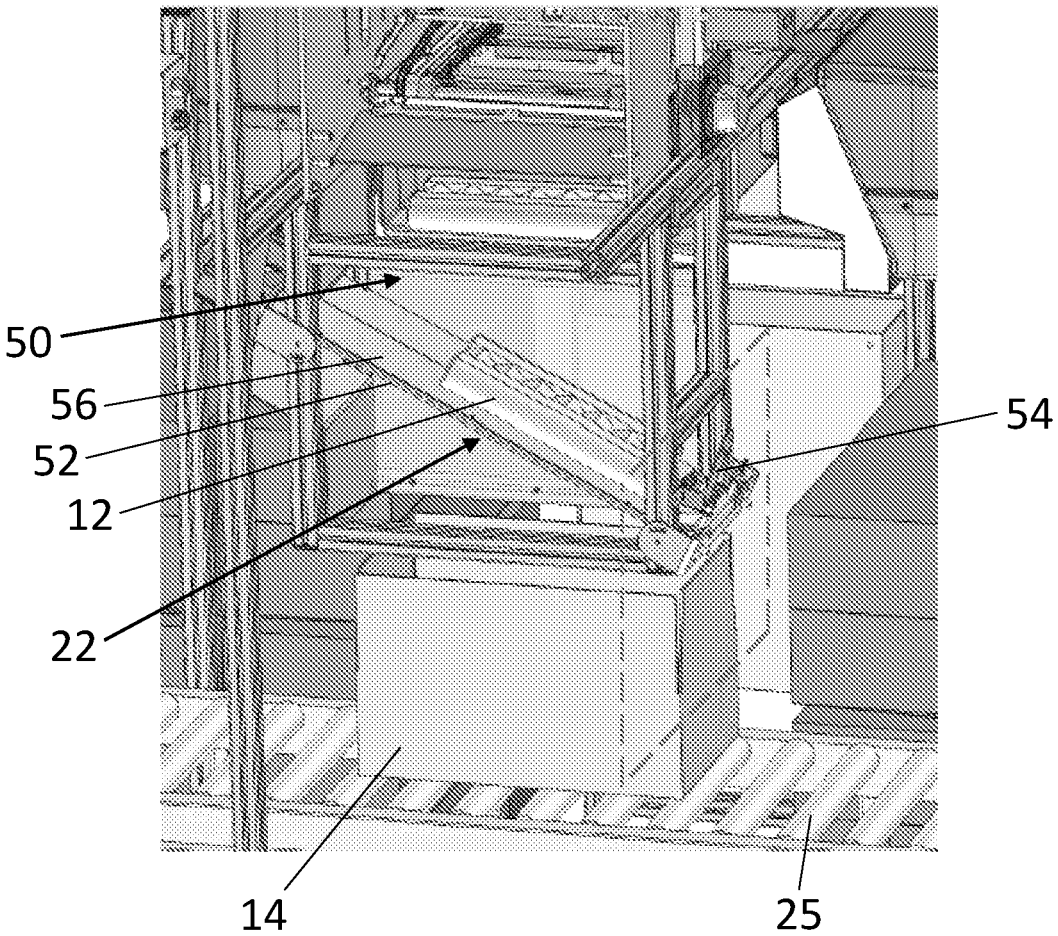
FIG. 5 is a perspective view of an exemplary dunnage placement apparatus of the packaging system of FIG. 3.

Now turning to FIG. 5, an exemplary embodiment of the staging member 18 will be described. In the illustrated embodiment, the staging member 18 includes a sloped bottom wall 52, the top surface of which may be a smooth surface, much like a slide. The sloped bottom wall 52 may extend from underneath the opening 50 of the dunnage transfer assembly 42 to the staging location 20 and may have a width at least the width of the dunnage product 12. Other forms of staging members may be used in conjunction with the packaging system 10, such as receptacles, conveyors, etc. The staging member 18 may be positioned relative to the opening of the dunnage transfer assembly 42 to provide a different controlled path to the staging location 20.

To optimize the "smoothness" of the top surface of the sloped bottom wall 52, the sloped bottom wall 52 may be made of a material or have a top surface formed from a material having a low coefficient of friction with respect to the dunnage product 12, such that the dunnage product 12 can slide substantially frictionlessly down the sloped bottom wall 52 with the force of gravity. Such a material may be, for example, ultra-high molecular weight (UHMW) plastic, stainless steel with a polytetrafluoroethylene (PTFE) coating, or #2B finish stainless steel, which is annealed, pickled, and bright cold rolled. As another alterative or additional feature, the staging member 18 may be configured to vibrate, either using actuators (not shown) that also provide rotational movement of the sloped bottom wall 52 of the staging member 18 (to drop the pads) by sequentially activating the actuators to 'wiggle' the wall 52 up and down to advance the pad to the staging location 20, or with an added vibration actuator electrically connected to the staging member 18, to encourage movement of the dunnage product 12 down the sloped bottom wall 52 of the staging member 18 and to the staging location 20 while maintaining proper alignment and orientation of the dunnage product 12.

The angle of the sloped bottom wall 52 may be fixed or may be adjustable. For example, the bottom wall 52 may be sloped or inclined with respect to a horizontal axis by an angle that is sufficient to cause the dunnage product 12 to slide down the sloped bottom wall 52 with the force of gravity. An exemplary angle may be about ten to seventy degrees, more preferably about ten to forty-five degrees, and preferably about twenty-five to thirty degrees. The staging member 18 may include a hinge that provides for angular adjustments and a locking mechanism for securing the sloped bottom wall 52 in a fixed angular orientation.

As another alternative, the sloped bottom wall 52 may have varying pitch angles along its slope. For example, the sloped bottom wall 52 may have a first pitch angle at a lower end portion and a slightly steeper second pitch angle at an upper portion thereof, or vice-versa. The first and second pitch angles may be selected to ensure that a dunnage product 12 deposited thereon will slide along the sloped bottom wall 52 to the staging location 20 located at the bottom thereof, where the dunnage product 12 may be registered with the alignment reference plane 28.

The staging member 18 also may include sidewalls (not shown) extending from at least one peripheral edge of the bottom wall 52. The height of the sidewalls may be at least the height of the dunnage product 12. The upstream end of the staging member 18 (proximal to the dunnage transfer assembly 42) may have a bottom wall 52 and sidewalls that are outwardly flared to form a wide mouth for capturing and guiding a leading end of the dunnage product 12 onto the staging member 18 atop the bottom wall 52 and between the sidewalls.

In the illustrated embodiment, the sloped bottom wall 52 of the staging member 18 may terminate at the alignment reference plane 28 with an end wall or stop mechanism 54. The stop mechanism 54 is configured to provide a stop at the downstream end of the staging member 18 (distal to the dunnage transfer assembly 42), against which a dunnage product 12 moving down the sloped bottom wall 52 will stop. The stop mechanism 54 generally is aligned with the alignment reference plane 28, such that when the dunnage product 12 reaches and stops at the stop mechanism 54, the dunnage product 12 is registered at the alignment reference plane 28. In other words, in the illustrated embodiment, the dunnage product 12 is registered at the alignment reference plane 28 when at least one point or at least one face of the dunnage product 12 is aligned with the stop mechanism 54 of the staging member 18 in the staging location 20.

Once the dunnage product 12 is registered at the alignment reference plane 28, its presence (and registration) may be detected by the dunnage sensor 30. The dunnage sensor 30 is configured to transmit the dunnage alignment signal to the controller 34 of the packaging system 10 after the dunnage sensor 30 detects the dunnage product 12 registered at the alignment reference plane 28, informing the controller 34 that the dunnage product 12 is registered with the alignment reference plane 28 in the staging location 20. The controller 34 thus knows that the dunnage product 12 is at the staging location 20, ready for the dunnage placement apparatus 22 to transfer the dunnage product 12 into the packaging container 14.

Figure 6:
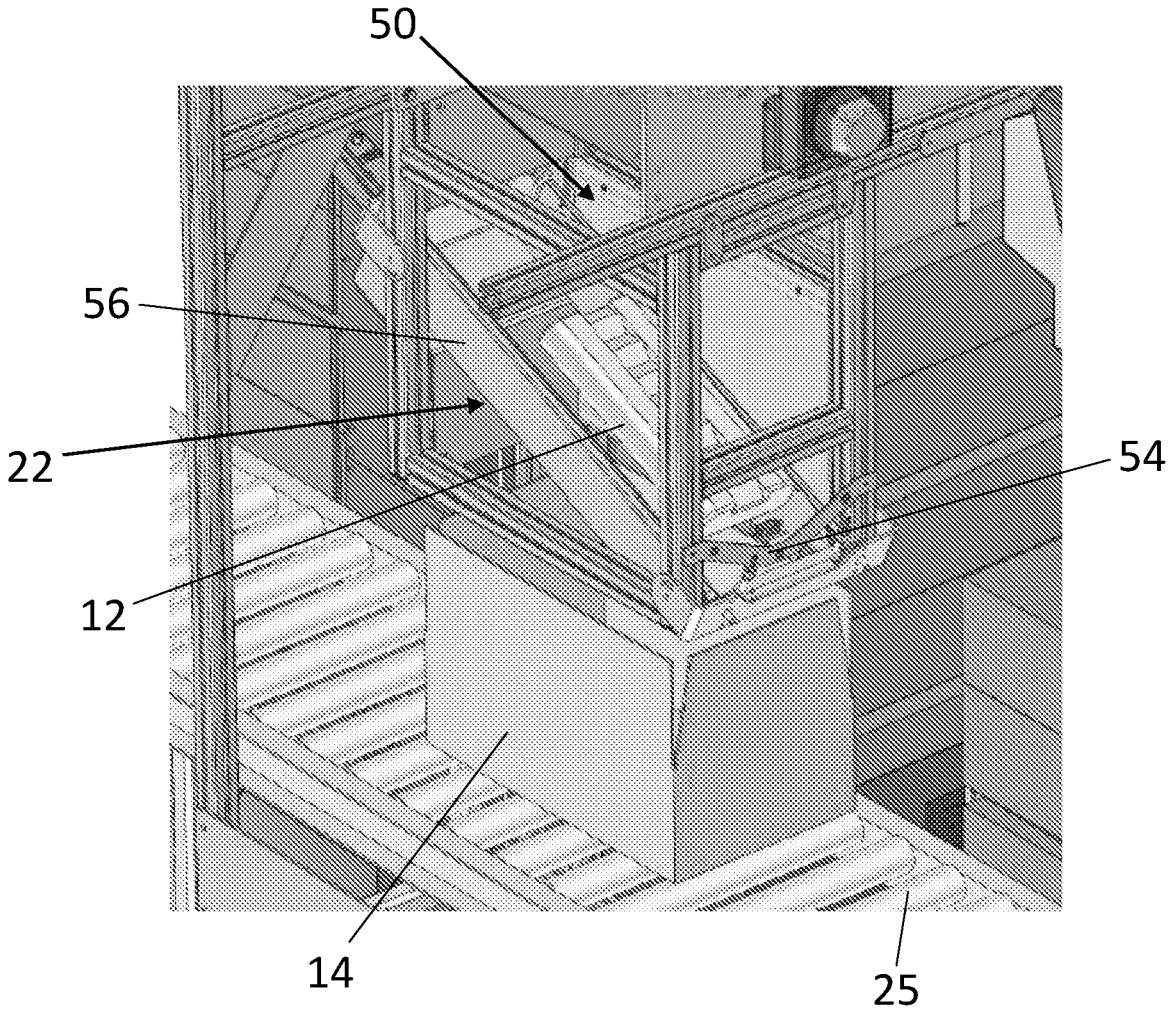
FIG. 6 is a perspective view of the dunnage placement apparatus of FIG. 5 in operation.

As shown in FIG. 6, the dunnage placement apparatus 22 may be integrated into the staging member 18 itself and include at least one pivotable gate member 56. For example, the sloped bottom wall 52 of the staging member 18 may include the at least one pivotable gate member 56. The at least one pivotable gate member 56 may be mounted for pivotal movement between open and closed positions, for example, by brackets or hinges attached to the sidewalls or bottom wall 52 of the staging member 18. Such pivotable movement may be effected by any suitable means, for example by an actuator operatively connected to the at least one gate member 56. When the at least one gate member 56 is in its closed position, the at least one gate member 56 (effectively forming the sloped bottom wall 52 of the staging member 18) supports the dunnage product 12 in the staging location 20. When the at least one gate member 56 is in its open position, however, the at least one gate member 56 no longer supports the dunnage product 12 in the staging location 20 (creating a passage through the sloped bottom wall 52 of the staging member 18) and instead transfers the dunnage product 12 to the packaging container 14 in the loading location 26. For example, in the embodiment in which the packaging container 14 is located in the loading location 26 underneath the staging location 20, when the at least one gate member 56 is in its open position, the dunnage product 12 may drop directly into the packaging container 14.

The dunnage placement apparatus 22, however, may be configured or operated in another manner to effect transfer of a dunnage product 12 from the staging location 20 into the packaging container 14 in the loading location 26. For example, the dunnage placement apparatus 22 may include a pick and place unit which is capable of engaging the dunnage product 12 when registered at the alignment reference plane 28 in the staging location 20 and transferring it into the packaging container 14 registered at the alignment reference plane 28 in the loading location 26.

Figure 7:
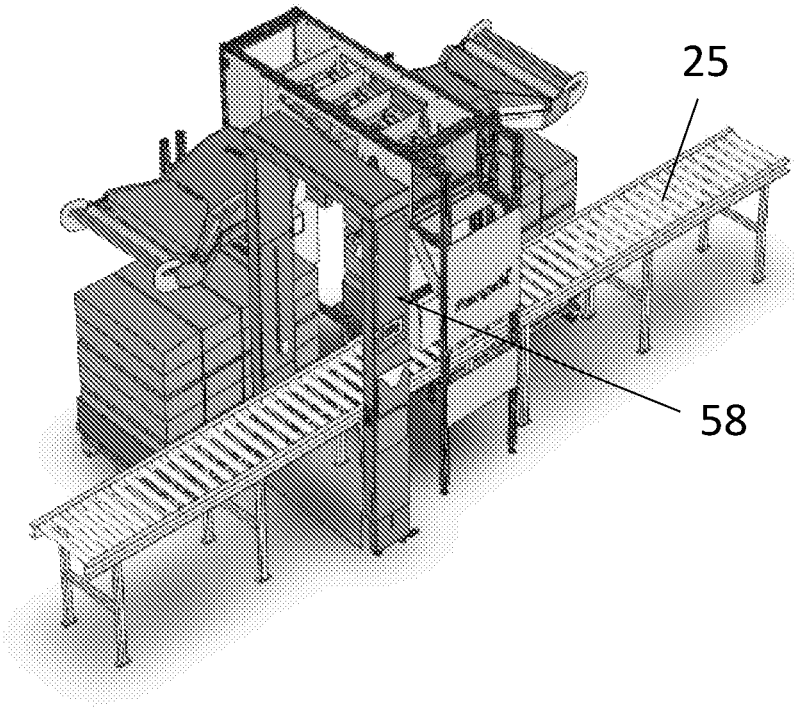
FIG. 7 is another perspective view of the packaging system of FIG. 3.
Figure 8:
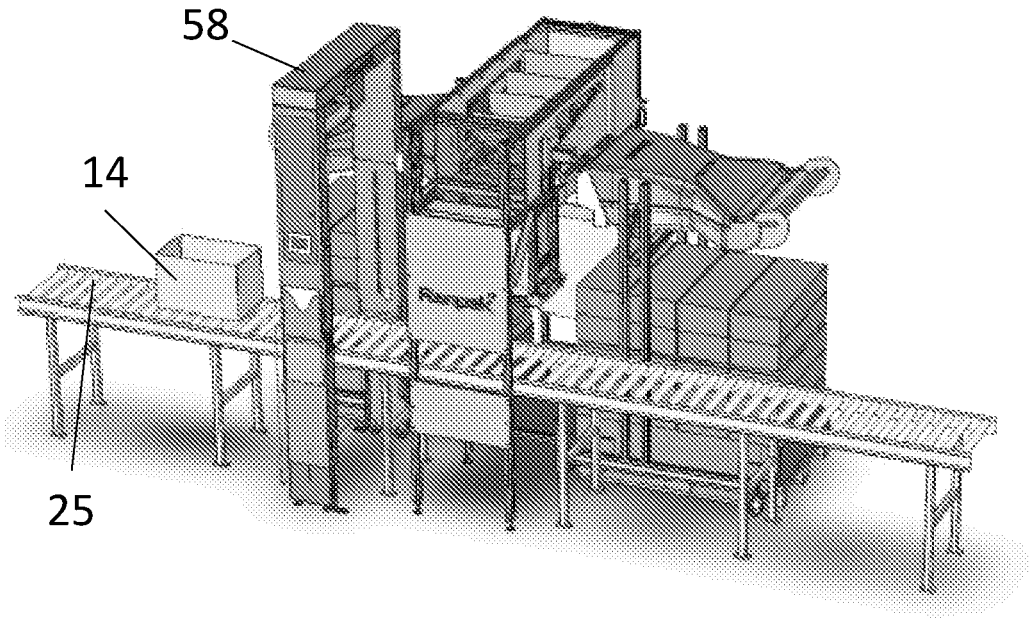
FIG. 8 is a perspective view of the packaging system of FIG. 3.

Turning now to FIGS. 6-8, the package conveyor assembly 24 of the packaging system 10 will now be described in more detail. As previously mentioned, the package conveyor assembly 24 of the packaging system 10 is configured to position, transfer, or convey the packaging container 14 to the loading location 26, where it may be accessible by the dunnage placement apparatus 22. The package conveyor assembly 24 may include a conveyor 25 made of, for example, a series of powered rollers or a belt that urges the packaging container 14 along the conveyor assembly 24 toward the loading location 26.

Figure 9:
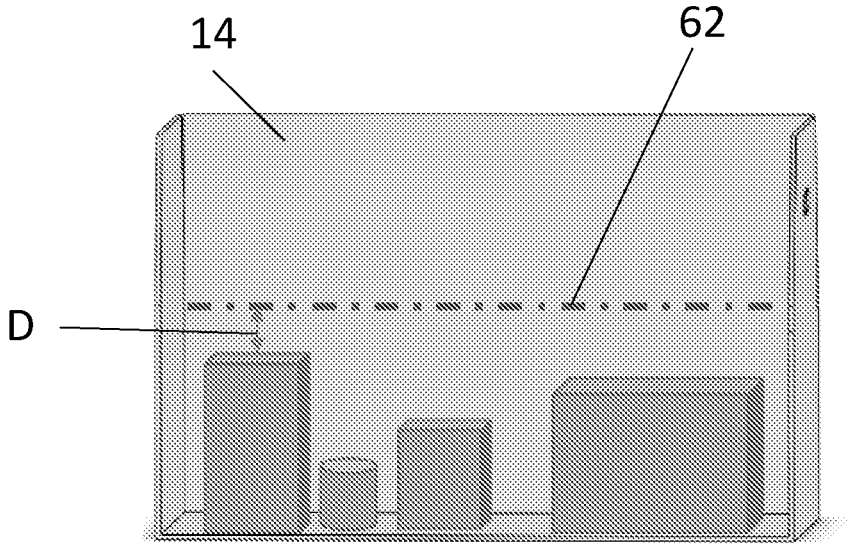
FIG. 9 is a cross-sectional perspective view of an exemplary packaging container having articles therein to be filled with a dunnage product using the packaging system of FIG. 1.

In the illustrated embodiment, the conveyor assembly 24 includes a package fill requirement sensor 58, depicted best in FIGS. 7 and 8. The package fill requirement sensor 58 may be of any suitable type, such as an optical sensor, and may be located adjacent to or on the conveyor 25 of the conveyor assembly 24. The package fill requirement sensor 58 is configured to determine the size and quantity of dunnage products 12 necessary to be transferred into any given packaging container 14 passing thereby. For example, as the packaging container 14 passes the packaging fill requirement sensor 58 on the conveyor 25, the packaging fill requirement sensor 58 may be configured to measure or detect a distance D between the tallest article 60 in the packaging container 14 and a max fill line 62 of the packaging container 14, depicted in FIG. 9. The packaging fill requirement sensor 58 may then be configured to send a fill requirement signal to the controller 34 after measuring the distance D, the fill requirement signal corresponding to a size and quantity of dunnage products 12 required to fill the packaging container 14. The controller 32 may then be configured to send a dunnage size and quantity signal to the dunnage supply 16, instructing the dunnage supply 16 to provide the required size and quantity of dunnage products 12 to the staging member 18 and in turn to the packaging container 14. The supply of multiple dunnage products 12 may be performed in a controlled manner using the dunnage transfer assembly 42 as previously described.

Other types of package fill requirement sensors may be used with the packaging system 10, such as ones that employ the use of reading elements. For example, the package fill requirement sensor may include a bar code reader for reading a code associated with the packaging container 14 passing thereby, the code being indicative of the size and quantity of dunnage products 12 required to be transferred to the packaging container 14. In the same way as previously described, the bar code reader may be configured to send the code as the fill requirement signal to the controller 32 and the controller 34 may be configured to send a dunnage size and quantity signal to the dunnage supply 16.

The conveyor 25 of the conveyor assembly 24 is configured to move the packaging container 14 to the alignment reference plane 28 in the loading location 26, where the package sensor 32 detects its presence. The conveyor 25 may include features that ensure proper alignment and orientation of the container 14 with respect the alignment reference plane 28. Once the packaging container 14 is registered at the alignment reference plane 28, its presence (and registration) may be detected by the package sensor 32. The package sensor 32 is configured to transmit the package alignment signal to the controller 34 of the packaging system 10 after the package sensor 32 detects the packaging container 14 registered at the alignment reference plane 28. The package alignment signal is transmitted to inform the controller 34 that the packaging container 14 is registered at the alignment reference plane 28 in the loading location 26. The controller 34 also may be configured to send a stop signal to the conveyor 25, upon receipt of which the conveyor 25 is configured to stop. Therefore, the packaging container 14 may be temporarily or permanently stopped in a position and location where it is registered at the alignment reference plane 28 in the loading location 26.

Upon receipt of both the dunnage alignment signal and the package alignment signal, the controller 34 is configured to transmit a dunnage placement signal to a dunnage placement apparatus 22. In the embodiment depicted in FIG. 6, upon receipt of the dunnage placement signal, the dunnage placement apparatus 22 is configured to pivot the at least one gate member 56 from its closed position to its open position, thereby allowing the dunnage product 12 to drop into the packaging container 14. In an embodiment in which there are at least two gate members 56 pivotable between a closed and open position, upon receipt of the dunnage placement signal from the controller 34, the dunnage placement apparatus 22 may be configured to pivot only one of the at least two gate members 56 from its closed position to its open position. In another embodiment, the dunnage placement apparatus 22 may be configured to pivot one of the at least two gate members 56 from its closed position to its open position and only partially pivot the other of the at least two gate members 56 from its closed position to a partially open position. In another embodiment, the dunnage placement apparatus may be configured to cooperatively partially pivot each of the at least two gate members from their closed positions to their partially open positions. In each embodiment, a controlled transfer of the dunnage product 12 from the staging location 20 into the packaging container 14 may be achieved, effectively steering the dunnage product 12 into a specific position or location of the packaging container 14.

Figure 10:
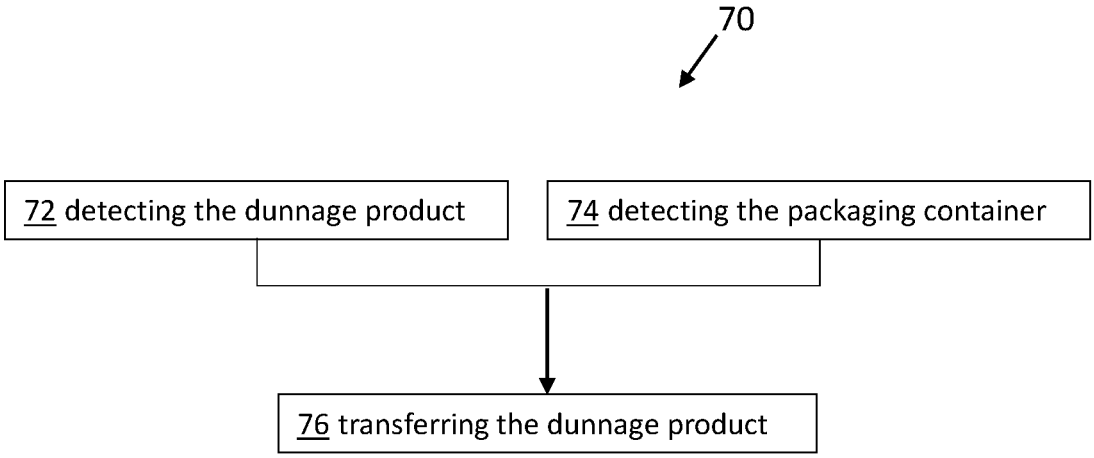
FIG. 10 is a schematic diagram of an exemplary packaging method.

A method of transferring a dunnage product to a packaging container, using the packaging system 10 described above, will now be described with reference to FIG. 10. The method includes the steps of detecting the dunnage product registered at the alignment reference plane in the staging location and detecting the packaging container registered at the alignment reference plane in the loading location. The method further includes the step of transporting the dunnage product from the staging location to the packaging container in the loading location after both the step of detecting the dunnage product registered at the alignment reference plane in the staging location and the step of detecting the packaging container registered at the alignment reference plane in the loading location.

The step of detecting the dunnage product registered at the alignment reference plane in the staging location may be performed by the dunnage sensor. The step of detecting the packaging container registered at the alignment reference plane in the loading location may be performed by the package sensor. The step of transporting the dunnage product from the staging location to the packaging container in the loading location may be performed by the dunnage placement apparatus.

The method may further include the steps of transmitting the dunnage alignment signal after the step of detecting the dunnage product registered at the alignment reference plane in the staging location, and transmitting the package alignment signal after the step of detecting the packaging container registered at the alignment reference plane in the loading location. The method also may include the step of transmitting, by the controller, upon receipt of both the dunnage alignment signal and the package alignment signal, the dunnage placement signal to the dunnage placement apparatus. The step of transporting the dunnage product may therefore occur upon receipt of the dunnage placement signal by the dunnage placement apparatus.

The step of detecting the dunnage product may occur when at least one point, or at least one face, on a periphery of the dunnage product is aligned with the alignment reference plane and the step of detecting the packaging container may occur when at least one point, or at least one face, on a periphery of the packaging container is aligned with the alignment reference plane. The step of detecting the dunnage product may occur when the dunnage product has an orientation aligned with the packaging container registered at the alignment reference plane in the loading location, and the step of detecting the packaging container may occur when the packaging container has an orientation aligned with the dunnage product registered at the alignment reference plane in the staging location.

The dunnage placement apparatus also may include at least one gate member pivotably mounted to a staging member, on which the staging location is located, for pivoting between an open and closed position. Accordingly, the step of transporting the dunnage product may include pivoting the at least one gate member from the closed position to the open position. The step of transporting the dunnage product may include dropping the dunnage product from the staging location to the packaging container in the loading location.

Although the invention has been shown and described with respect to a certain embodiment, equivalent alternations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiments of the invention. In addition, while a particular feature of the invention may have been described above with respect to only one of several illustrated embodiments, such feature may be combined with one or more other features of the other embodiments, as may be desired and advantageous for any given or particular application.

We claim:

1. A packaging system for transferring a dunnage product to a packaging container, the packaging system comprising:

a dunnage sensor configured to detect the dunnage product registered at an alignment reference plane in a staging location;

a package sensor configured to detect the packaging container registered at the alignment reference plane in a loading location; and a dunnage placement apparatus configured to transfer the dunnage product from the staging location to the packaging container in the loading location after both the dunnage sensor detects the dunnage product registered at the alignment reference plane in the staging location and the package sensor detects the packaging container registered at the alignment reference plane in the loading location, and further comprising:

a controller configured:

to receive a dunnage alignment signal, transmitted from the dunnage sensor, after the dunnage sensor detects the dunnage product registered at the alignment reference plane in the staging location;

to receive a package alignment signal, transmitted from the package sensor, after the package sensor detects the packaging container registered at the alignment reference plane in the loading location; and to transmit, upon receipt of both the dunnage alignment signal and the package alignment signal, a dunnage placement signal to the dunnage placement apparatus;

wherein upon receipt of the dunnage placement signal, the dunnage placement apparatus is configured to transfer the dunnage product from the staging location to the packaging container in the loading location.

2. The system of claim 1, wherein the dunnage sensor is configured to detect the dunnage product registered at the alignment reference plane in the staging location when at least one point, or at least one face, on a periphery of the dunnage product is aligned with the alignment reference plane.

3. The system of claim 1, wherein the package sensor is configured to detect the packaging container registered at the alignment reference plane in the loading location when at least one point, or at least one face, on a periphery of the packaging container is aligned with the alignment reference plane.

4. The system of claim 1, wherein the staging location is positioned above, in a vertical direction, the loading location.

5. The system of claim 1, wherein the dunnage sensor is configured to detect the dunnage product registered at the alignment reference plane in the staging location when the dunnage product has an orientation aligned with the packaging container registered at the alignment reference plane in the loading location, and wherein the package sensor is configured to detect the packaging container registered at the alignment reference plane in the loading location when the packaging container has an orientation aligned with the dunnage product registered at the alignment reference plane in the staging location.

6. The system of claim 1, further comprising a staging member for positioning the dunnage product in the staging location, the staging member having a sloped bottom wall terminating at the alignment reference plane in the staging location.

7. The system of claim 6, wherein the dunnage placement apparatus includes at least one gate member pivotably mounted to the staging member for pivoting between an open and closed position, wherein in the closed position the at least one gate member is configured to support the dunnage product in the staging location, and wherein in the open position the at least one gate member is configured to transfer the dunnage product from the staging location to the packaging container in the loading location.

8. The system of claim 7, wherein upon receipt of the dunnage placement signal, the at least one gate member is configured to pivot from the closed position to the open position.

9. The system of claim 1, further comprising a supply of dunnage product.

10. The system of claim 9, wherein the supply includes a dunnage conversion machine.

11. The system of claim 9, wherein the supply includes a dunnage transfer assembly configured to transfer the dunnage product from the conversion machine to the staging member.

12. A method of transferring a dunnage product to a packaging container, the method comprising the steps of:

detecting the dunnage product registered at an alignment reference plane in a staging location;

detecting the packaging container registered at the alignment reference plane in a loading location; and transporting the dunnage product from the staging location to the packaging container in the loading location after both the step of detecting the dunnage product registered at the alignment reference plane in the staging location and the step of detecting the packaging container registered at the alignment reference plane in the loading location, transmitting a dunnage alignment signal after the step of detecting the dunnage product registered at the alignment reference plane in the staging location, transmitting a package alignment signal after the step of detecting the packaging container registered at the alignment reference plane in the loading location; and transmitting, by a controller, upon receipt of both the dunnage alignment signal and the package alignment signal, a dunnage placement signal to a dunnage placement apparatus;

wherein the step of transporting the dunnage product occurs upon receipt of the dunnage placement signal by the dunnage placement apparatus.

13. The method of claim 12, wherein the step of detecting the dunnage product is performed by a dunnage sensor, the step of detecting the packaging container is performed by a package sensor, and the step of transporting is performed by the dunnage placement apparatus.

14. The method of claim 13, wherein the step of detecting the dunnage product occurs when at least one point, or at least one face, on a periphery of the dunnage product is aligned with the alignment reference plane.

15. The method of claim 12, wherein the step of detecting the packaging container occurs when at least one point, or at least one face, on a periphery of the packaging container is aligned with the alignment reference plane.

16. The method of claim 12, wherein the step of detecting the dunnage product occurs when the dunnage product has an orientation aligned with the packaging container registered at the alignment reference plane in the loading location, and wherein the step of detecting the packaging container occurs when the packaging container has an orientation aligned with the dunnage product registered at the alignment reference plane in the staging location.

17. The method of claim 12, wherein the dunnage placement apparatus includes at least one gate member pivotably mounted to a staging member, on which the staging location is located, for pivoting between an open and closed position, and wherein the step of transporting the dunnage product includes pivoting the at least one gate member from the closed position to the open position.

18. The method of claim 12, wherein the step of transporting the dunnage product includes dropping the dunnage product from the staging location to the packaging container in the loading location.

* * * * *